United States Patent [19]

Hugo

[11] Patent Number: 4,617,572

[45] Date of Patent: Oct. 14, 1986

[54] TELEVISION DISH ANTENNA MOUNTING STRUCTURE

[76] Inventor: Albert Hugo, P.O. Box 87 6325 Carpinteria Ave., Carpinteria, Calif. 93013

[21] Appl. No.: 640,620

[22] Filed: Aug. 14, 1984

[51] Int. Cl.[4] ..... H01Q 3/08

[52] U.S. Cl. ..... 343/765; 343/882; 343/766; 248/183

[58] Field of Search ..... 343/765, 766, 878, 880–882, 343/840; 248/180, 183, 184, 519, 521, 522, 527, 530

[56] References Cited

U.S. PATENT DOCUMENTS

| | | | |
|---|---|---|---|
| 3,495,261 | 2/1970 | Lastinger et al. | 343/766 |
| 4,126,865 | 11/1978 | Longhurst et al. | 343/766 |
| 4,454,515 | 6/1984 | Major et al. | 343/882 |
| 4,475,110 | 10/1984 | Hutchins | 343/766 |

FOREIGN PATENT DOCUMENTS

| | | | |
|---|---|---|---|
| 58-95406 | 6/1983 | Japan | 343/880 |
| 2051484 | 1/1981 | United Kingdom | 343/766 |

*Primary Examiner*—Eli Lieberman
*Assistant Examiner*—Michael C. Wimer
*Attorney, Agent, or Firm*—Georges A. Maxwell

[57] ABSTRACT

A motor-driven adjustable mounting structure for satellite T.V. dish antennae which operates to scan an in line of sight segment of a geostationary T.V. relay satellite orbit belt. The mounting structure includes a vertical mounting post, a universal levelling structure atop the post, a vertically extending body pivotally carried by the levelling structure on a horizontal axis, a head structure rotatably carried by and projecting upwardly from the body and including an antenna carrier structure carrying the antenna with its axis normal to the vertical axis of the body and turning axis of the head. The mounting structure further includes a motor driven drive to rotate the head relative to the body and comprising a quadrant gear fixed to the head on an axis concentric with the turning axis of the head, a worm gear rotatably carried by the body and drivingly engaging the quadrant gear, a gear reduction box carried by the body and driving the worm gear and a reversible electric motor carried by and driving the gear box. The mounting structure further includes structure to pivot the body relative to the levelling structure and adjust the inclination of the antenna and comprising a lever arm fixed to and projecting from the body on a plane parallel with the axis of the antenna and an axially extensible strut structure fixed to and extending between the free end of said arm and said levelling structure at a point spaced below the pivotal axis of the body.

11 Claims, 7 Drawing Figures

H
47
41
49
3
43
45
46
48
D
60
G
52
W
5
40
50
C
35
S
B
38
37A
32
31
X
L
37
20
25
21
22
37B
26
23
T
39
P
4
42
M
27
28
30
39
H
B
60
W
C
D
52
G
40
S

TELEVISION DISH ANTENNA MOUNTING STRUCTURE

This invention has to do with an improved television dish antenna mounting structure.

BACKGROUND OF THE INVENTION

In the recent past, that system and apparatus for controlled transmission and reception of radio and television signals which consists of directing transmitted signals from earth-based transmission stations to satellites in geostationary orbits above the earth and relaying those signals, by means of the satellites, back to the earth to be picked up or received by earth-based receiving stations has become well established and is being put to ever-increasing use.

The majority of persons actively engaged in the establishment, maintenance and use of the above system, for the purpose of convenience, refer to and identify that system as "satellite T.V.".

In establishing, expanding and maintaining satellite T.V. for good and practical reasons, the satellites are propelled from earth by rockets and are set in substantially precise predetermined orbit in what is called the "Clark belt" or "geostationary satellite belt". The geostationary satellite belt is an area about 22,300 miles above the earth's equator which extends about and is substantially concentric with the equator. The satellites set in orbit in the Clark or geostationary orbit belt travel at a speed matched exactly with the earth's rotation and are such that they are effective to receive signals from and return signals to those portions of the earth's surface which are within the line of sight therebetween. Accordingly, for example, those satellites which receive signals from and return signals to the North American continent are those satellites which are set in that segment of the Clark or geostationary orbit belt which are in the line of sight from the North American continent. The circumferential extent of that segment of the Clark belt in which satellites serving the North American continent are set is approximately 80°. Those satellites now in orbit in the noted segment of the Clark belt are spaced apart, circumferentially of that belt approximately 5.5°. It is anticipated that in the foreseeable future the number of such satellites within the segment of the Clark belt serving the North American continent will be doubled and that the spacing between adjacent satellites will be reduced to close to 2° or 3°.

In the practical use and operation of the satellite T.V. system served by the above noted relay satellites, the signal receiving stations at the earth's surface are designed to and capable of receiving and using the signals relayed and/or transmitted from but one satellite at a time. Accordingly, the signal receiving stations must be capable of selectively receiving the signals from a desired or selected one of the satellites without receiving interferring signals from the other, nonselected satellites. To this end, the signal receiving stations are characterized by and/or include large accurately made concave dish antenna which are carefully aimed at a selected satellite to receive the signals which are received by and relayed back to earth thereby.

It is to be noted that the signals relayed or transmitted by the satellites are directed or beamed at specific areas of the earth's surface, which areas are referred to as the satellite "footprints" and that the signals transmitted thereby can only be effectively picked up by the dish antenna of receiving stations which are positioned within the footprints of the satellites.

In the overwhelming majority of receiving stations, particularly those receiving stations which are provided for domestic use and/or for limited special use, the dish antenna of the receiving stations are installed and permanently set in line with and receive the signals transmitted or relayed from one selected satellite. While some of those antennae may be capable of being adjusted and reset to receive the signals from other of the satellites, such adjustment and resetting of those antennae is a major time-consuming operation which requires the exercise of special skills and in some instances, cannot be defined as a mere "adjustment" but rather, is considered and likened to "reinstallation" of the antennae.

In a limited number of special receiving stations, the dish antennae are equipped with special and extremely complicated and costly adjustable mounting means which are operable to selectively move and set the antennae in line with and to receive the signals transmitted or relayed from any selected one of the satellites in whose footprints the antennae are positioned. Such adjustable antennae mounting structures greatly increase the number of signals that can be received and the useful capacity of the receiving stations.

Those prior art adjustable antennae mounting means of which I am aware include remotely controlled motor driven ground-supported turn-tables or the like, atop which the dish antennae are mounted and which include various remotely operable means to adjust the positions of the antennae related to the turn-tables, for fine adjustment and aiming of the antennae. To date, to the best of my knowledge and belief, those remotely controlled adjustable antennae mounting means provided by the prior art have been extremely complicated and costly means and/or structures for those very large and heavy T.V. dish antennae which are provided for and used in commercial and/or industrial receiving stations, where abundant space to accommodate such structures is available and where the high cost for such structures can be justified and/or is of no major concern. To the best of my knowledge and belief, the prior art has failed to provide a relatively inexpensive and practical remotely controlled, motor driven, adjustable T.V. dish antenna mounting means which is effective to selectively aim and set the greater and ever-increasing number of small and relatively inexpensive dish antennae for domestic receiving stations, in spite of a large and ever-increasing need and/or demand for such a mounting means.

While more might be said with respect to the physical makeup and function of all that is entailed in and goes to make up the transmitting stations, relay satellites and receiving stations for satellite T.V., such relates to matters which do not directly affect the mounting, moving and setting of the dish antennae of the receiving stations with which my invention relates and therefore need not and will not be further considered.

OBJECTS AND FEATURES OF MY INVENTION

It is an object of my invention to provide a novel remotely operable, motor driven satellite T.V. dish antenna mounting structure which is operable to selectively move a related antenna into aimed receiving alignment with any selected one of the T.V. relay satellites in the Clark belt, the footprints of which overlie or embrace the antenna.

It is an object and a feature of my invention to provide a dish antenna mounting structure of the general character referred to which is small, lightweight, compact and which is particularly suited for mounting that small and light type or class of dish antennae which are provided for use in domestic, non-commerical or non-industrial satellite T.V. receiving stations.

It is another object and feature of my invention to provide a dish antenna mounting structure of the general character referred to which can be made, sold and installed at a modest cost which is affordable to the great majority of those persons who purchase and equip themselves with satellite T.V. equipment.

Yet another object and feature of my invention is to provide a dish antenna mounting structure of the general character referred to above which is sufficiently small, light and compact so that it can be used instead of and/or incorporated in and with parts of a great number of those non-adjustable dish antennae mounting structures which are now in use.

It is yet another object and feature of my invention to provide a novel adjustable dish antenna mounting means of the general character referred to above which requres no appreciable additional space than is required for common nonadjustable antennae mounting structures and which is such that it can be installed, set and maintained without the exercise of any special or extraordinary skills.

The foregoing and other objects and features of my invention will be apparent and will be understood from the following description of my invention, throughout which description reference is made to the accompanying drawings:

DESCRIPTION OF THE INVENTION

Figure 1:
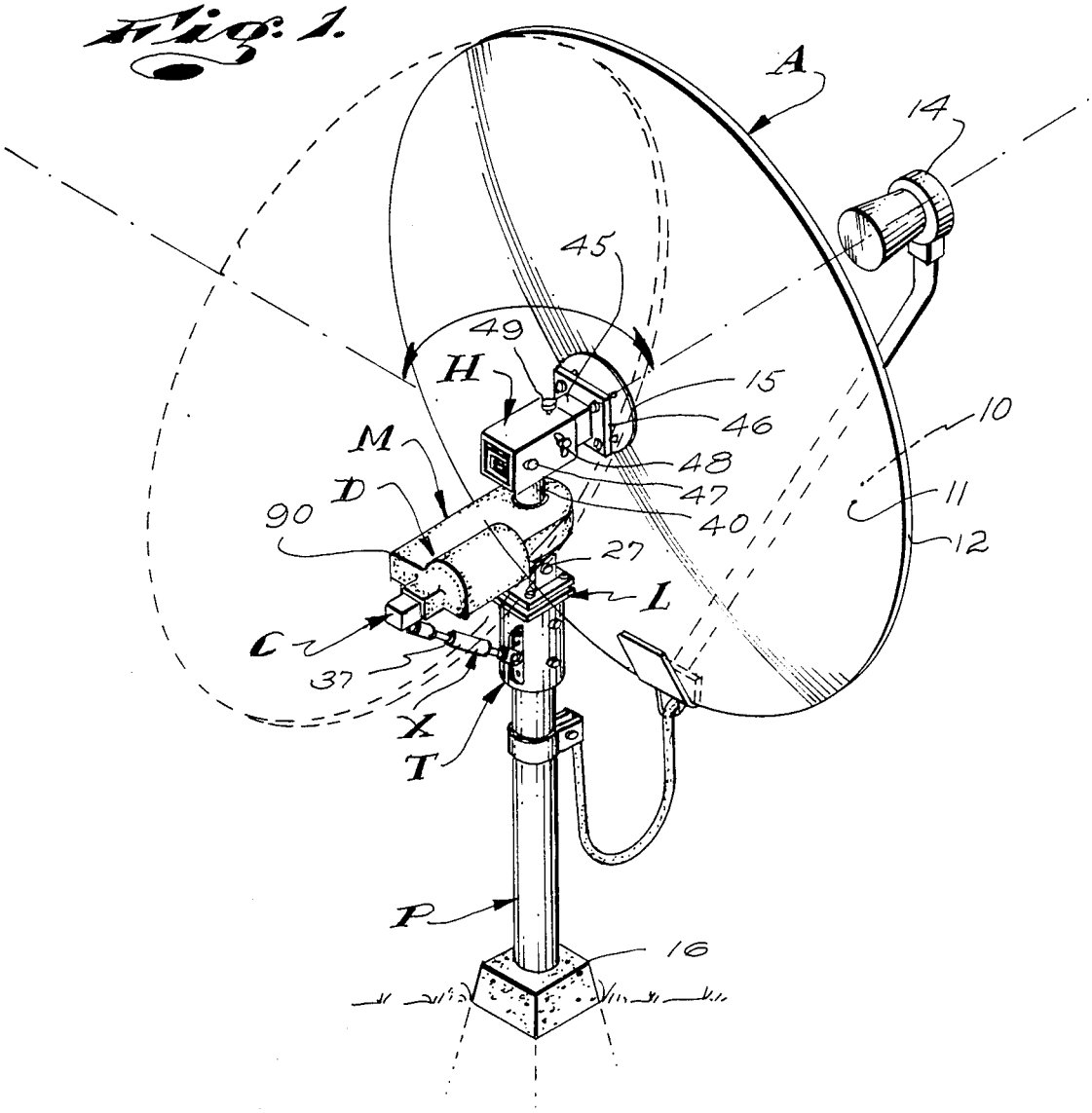
FIG. 1 is an isometric view of a satellite T.V. dish antenna with my new dish antenna mounting structure related to it.

In FIG. 1 of the drawings, I have shown a satellite T.V. dish antenna A for a satellite T.V. receiving station. The antenna is supported by my new antenna mounting structure M. The antenna A is a concave, convex dish-like structure. The concave or front surface 10 thereof is adpated to be aimed at and/or disposed directly toward a satellite in the Clark belt which relays or transmits those radio and/or T.V. signals which are to be received. The antenna A also has a convex rear surface 11 and an outer annular rim 12. A feed horn 14 is mounted on the antenna and is positioned forward of the surface 10 at the focal point thereof to receive and channel signals received by the antenna to those related radio and T.V. signals receiving components of the receiving station (not shown) which are well known in the art and which need not be described for a complete description and clear understanding of my invention. The antenna A next and finally includes a central rearwardly disposed mounting pad 15 or other appropriate mounting structure at the center of its rear convex surface 11 to facilitate securing the antenna on or to a suitable mounting structure, such as my mounting structure M. The antenna A can be made of any desired one or more of those materials suitable for the establishment of such antenna and can be varied widely in details of construction without affecting the novelty of my invention.

In practice, that class of T.V. dish antenna which my mounting structure M is designed to mount are from nine to twelve feet in diameter and weigh from 100 lbs. to 225 lbs. In anticipation of those advances which will be made in the design and construction of such dish antennae, I have designed and constructed my mounting structure M so that it can be advantageously used to mount antennae which are substantially greater than twelve feet in diameter and which are substantially less than nine feet in diameter.

The mounting structure M that I provide includes an elongate vertical mounting post P, the lower end of which is set and anchored in a mounting pad 16 securely set in the earth at the surface thereof. The post P is a strong and rigid tubular metal part and the pad 16 can, in accordance with common practice, be a large body or block of poured concrete. In practice, when my new mounting structure is installed in place of a preexisting non-adjustable dish antenna mounting structure which includes an earth-mounted support post, that post can frequently be utilized as the post P of my new mounting structure.

At the upper end of the post P is a levelling device L comprising vertically spaced, flat, horizontal, upper and lower plates 20 and 21. At least one of the plates 20 and 21 has a central concave seat 22 opposing the other plate. A central spherical support bearing or ball 23 is positioned between the plates 20 and 21 and is set in the seat or seats 22. A plurality (four) of elongate, vertically extending nut and bolt assemblies 25, arranged in radial outward and circumferential spaced relationship about the centers of the plates and the ball 23, extend through and between the plates. The lower plate 21 of the means L has a central elongate vertical mounting tube T tube T fixed to it and depending from it. The tube T is slidably engaged about the upper end portion of the post P with the top of the post stopped at the plate 21. The tube T carries lock screw fasteners 26, accessible at the exterior of the tube, and which are operable to engage the post P to effectively lock the tube and post in secure set relationship. In practice, it is preferred that at least two circumferentially and longitudinally spaced lock screw fasteners 26 be carried by the tube T.

The top plate 20 of the means L carried an upwardly projecting clevis structure comprising a pair of flat, vertical, laterally spaced clevis plates 27 with horizontally extending axially aligned fastener receiving openings 28. The clevis structure is centrally aligned with the means L and the plates 27 have lower ends fixed to the plates as by welding.

The nut and bolt assemblies 25 are manually operable to pivot the upper plate 20 on the ball 23 and relative to the lower plate 21 and to move and set the upper plate horizontal. Thus, the means L is operable and effective to adjust and compensate for any vertical misalignment of the post P and/or the tube T, whether misalignment of the post and/or tube occurs during or subsequent to installation and assembly of the structure.

In practice, the lower plate 21 of the means L is sufficiently large so that tubes T of different longitudinal and cross-sectional extent can be fixed to it. Thus, my mounting structure M can be established to be effectively related to and engaged with the upper end of most standard sizes of pipe or tubing that are commonly used to mount T.V. dish antennae by changing the size and/or shape of the tube T. Accordingly, my new mounting means can be easily and conveniently added to or incorporated in most existing T.V. dish antenna mounting structures of that type or class which include fixed vertical mounting posts.

The mounting structure M that I provide next includes an elongate carrier body B with upper (outer) and lower (inner) ends. The inner lower end portion of the body is positioned between the clevis plates 27 on the plate 20 of the means L. The body B has flat, vertical, laterally outwardly and oppositely disposed outside surfaces 30 which oppose and are in flat bearing engagement with the inner opposing surfaces of the clevis plates 27 and has laterally outwardly opening threaded openings entering its aligned surface 30 which are aligned with openings 28 in the clevis plates. Clamp bolts 31 with related washers 32 are rotatably engaged through the openings 28 in the plates and thence into said threaded openings in the body B to pivotally mount the lower end portion of the body with and between the clevis plates 27. The bolts 31 are such that when advanced in the body, they releasably clamp the body B in desired set (pivotal) position with and between the clevis plates and relative to the remainder of the levelling means L.

It is to be noted that by adjustment of the levelling means L, the pivotal axis of the body B which is concentric with the bolts 31, can be set horizontal and the longitudinal axis of the body can be set vertically.

The body B has an elongate, central, longitudinally extending cylindrical bore 35. The bore 35 opens at the upper and lower ends of the body and slidably and rotatably receives an elongate cylindrical stem S on a related head, which stem and head will be described in the following.

In practice, as shown in the drawings and for ease and convenience of manufacture, the body B is fabricated of and outer elongate square in cross-section tube part which establishes the desired flat outside surfaces 30 and an inner elongate cylindrical in cross-section tube part, engaged through and fixed in the outer part as by welding. The inner part establishes the bore 35. In practice, the upper and lower ends of the inner tube part extend outwardly from their related ends of the outer tube part and establish desired upper and lower annular end bearing surfaces on the body.

The body B next includes an elongate, horizontal lever arm C fixed to and projecting laterally and rearwardly from the upper end of the outer body part and with which an axially adjustable strut means X is fixed. The strut means X extends between the outer end of the arm C and the lower portion of the tube T, as shown in the drawings and as will hereinafter be described.

The arm C is a simple, straight, tubular, metal part fixed to the upper rear portion of the body B (the outer tube part thereof) as by welding.

The axially adjustable strut means X can vary widely in form and construction. In the case illustrated, the means X is shown as a simple, elongate, axially extensible turnbuckle 37. The turnbuckle 37 extends upwardly and rearwardly from the tube T to the outer rear portion of the arm C and has an upper threaded shaft or part $37^A$ pivotaly coupled to an apertured pad 38 on the outer free end of the arm C and a lower threaded shaft or part $37^B$, the free end of which is pivotally coupled with an apertured pad 39 on the lower end of the tube T, as clearly shown in the drawings. The pad 39 is preferably of substantial vertical extent and has a plurality of vertically spaced openings so that the part $37^B$ of the turnbuckle 37 can be set in different positions, vertically on the tube T, to effect desired adjustment of the mounting structure through a wide range of movement.

Figures 2, 3, 4, 5:
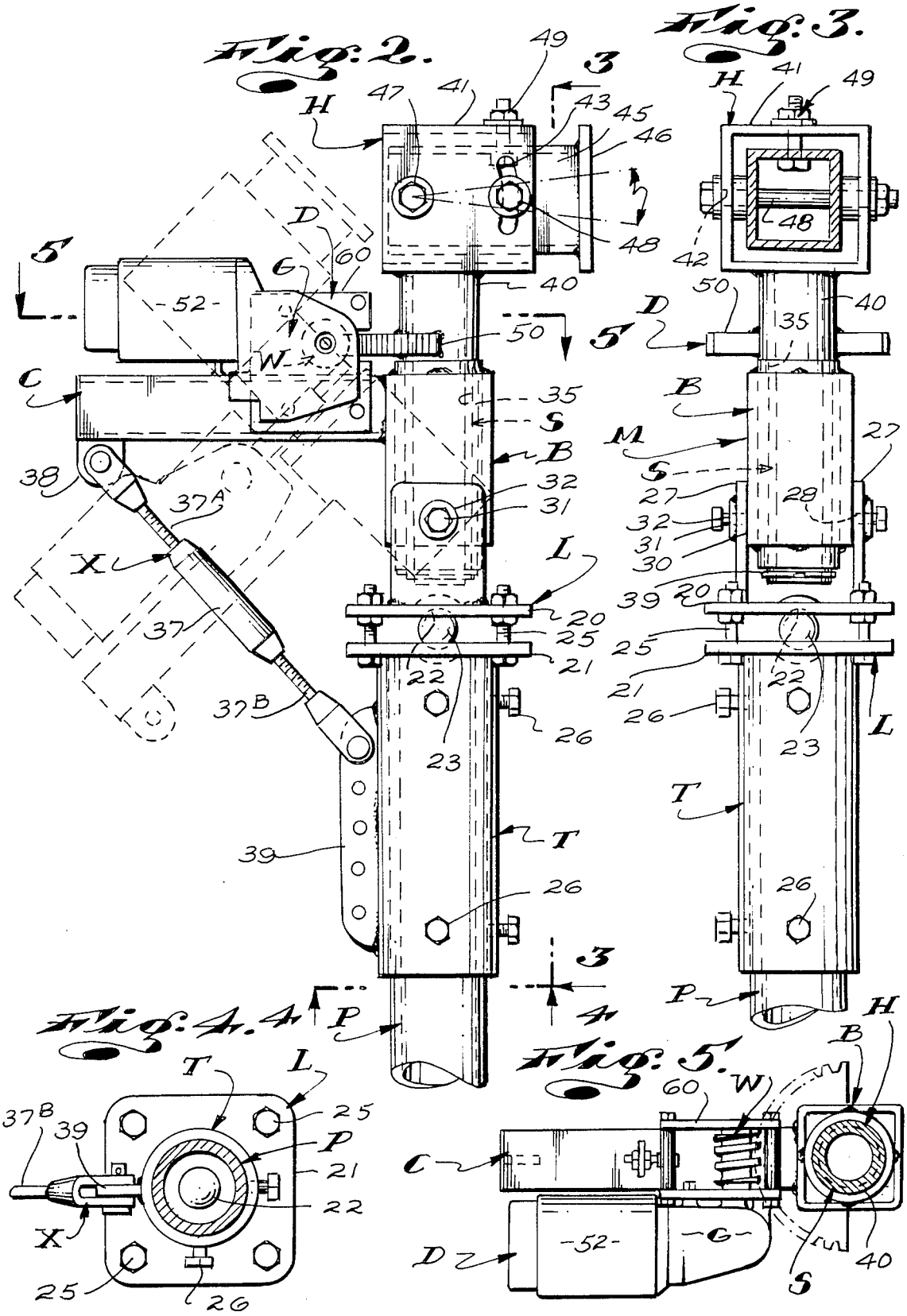
FIG. 2 is a side elevational view of my mounting structure showing parts in different positions in dotted lines.
FIG. 3 is a view taken as indicated by line 3—3 on FIG. 2.
FIG. 4 is a view taken as indicated by line 4—4 on FIG. 2.
FIG. 5 is a view taken as indicated by line 5—5 on FIG. 2.
Figures 6, 7:
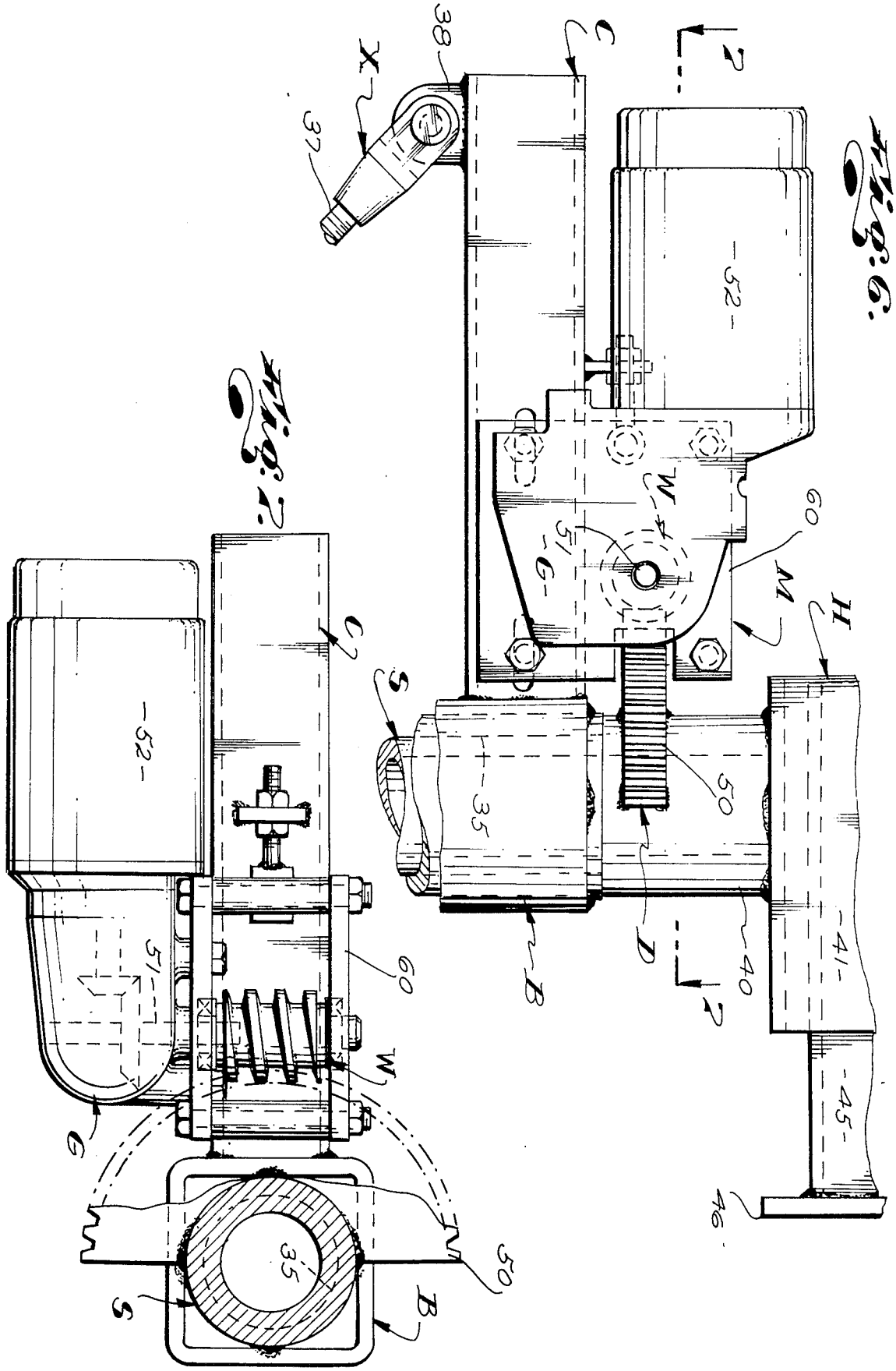
FIG. 6 is an enlarged view of a portion of the structure shown on FIG. 2.
FIG. 7 is a view taken as indicated bvy line 7—7 on FIG. 6.

By extending and shortening the turnbuckle, the outer end of the arm C is raised and lowered and the body B is pivoted about its lower horizontal pivotal axis, as indicated in dotted lines in FIG. 2 of the drawings. This movement of the body effects adjustment of the elevation angle of the antenna A, as will hereinafter be described.

My new mounting structure M next includes an antenna mounting head H carried by the body B. The head H includes an elongate, normally substantially vertically extending cylindrical shaft-like spindle S with upper and lower ends. The spindle S is rotatably slidably engaged in and through the bore 35 in the body B. The head H next includes an enlarged, substantially vertically extending cylindrical boss 40 which is preferably formed integral with and extends axially from the upper end of the spindle. The lower end of the boss 40 established axially stopped rotary, delete to occur in stopped to occur in stopped bearing engagement with the annular bearing surface at the upper end of the body. The lower end of the spindle extends from the lower end of the bore 35 in the body and carries an annular snap ring 39 which projects radially outward from the spindle to engage the lower annular bearing surface of the body and prevent axial upward displacement of the head relative to the body B.

In addition to the spindle S and boss 40, the head H has or includes an elongate, normally substantially horizontal tubular carrier sleeve 41 with open front and rear ends. The sleeve 41 is fixed to the upper end or top of the boss 40 as by welding and has a pair of rear bearing openings 42 in its rear end portion and a pair of substantially vertically extending arcuate slots 43 in its forward portion. The sleeve 41 is preferably square in cross-section. The pair of openings 42 in the rear portion of the sleeve 41 enter opposite sides of the sleeve, are aligned with each other and are on a horizontal axis which is spaced above and is parallel with the pivotal axis of the body B. The pair of vertically extending arcuate slots 43 in the forward portion of the sleeve 41 are in opposite sides of the sleeve, are aligned with each other, and are on a horizontal axis spaced from and parallel with the axis of the openings 42 and the pivotal axis of the body B. The slots are spaced forward or outward of and are curved about the axis of the openings 42.

In addition to the foregoing, the head H includes an elongate, normally substantially horizontal preferably tubular carrier pin 45 with an inner or rear end portion concentric with and extending freely in and through the sleeve 41 and with a forward portion projecting freely forwardly from the sleeve 41. The outer or forward end of the carrier pin 45 has fixed to it and carries a flat, antenna mounting plate 46 on a plane normal to the axis of the pin.

The rear end of the carrier pin 45 is pivotally mounted within the rear portion of the sleeve 41 by a pivot pin 47. The pivot pin 47 is established by the shank of a bolt and a nut assembly (47) engaged in and through the rear openings 42 in the carrier sleeve 41 and in and through registering openings in the carrier pin 45, as clearly shown in the drawings. The portion of the carrier pin 45 forward of the pivot pin 47 is guided for pivotal movement about the pivot pin 47 by a through bolt, nut and washer assembly 48 engaged through and between the slots 43 in the carrier sleeve and in and through registering openings in the carrier pin.

The head H next includes a vertical set screw or bolt 49 engaged in and through a vertical opening in the top of the carrier sleeve 41 and into the upper forward portion of the carrier pin. The set screw 49 is such that by turning or advancing it vertically upwardly and/or downwardly in the carrier pin, the forward portion of the carrier pin is pivoted vertically upwardly and/or downwardly about the pivot bolt 47 and relative to the central longitudinal axis of the carrier sleeve.

In practice, suitable spacer sleeves are engaged on the through bolts 47 and 48 between the support sleeve and support pin so that the bolts 47 and 48 can be tightened and releasably clamp the support sleeve and support pin in desired set relationship with each other.

The combination and relationship of parts made up by the support sleeve 41, support pin 45 and pivot pin 47, fastener 48 and screw 49 provide for fine adjustment of the declination angle of the pin 45 and the antenna A as will hereinafter be described.

The antenna mounting plate 46 at the forward end of the carrier pin 45 is preferably a flat metal pad with suitable fastener receiving openings (not shown) therein and on which the mounting pad 15 on their antenna A can be suitably screw-fastened, either directly or by means of some suitable intermediate mounting adapter means.

Finally, the head H includes a 180° quadrant gear 50 fixed to and concentric with the boss 40 of the head H. The quadrant gear is fixed to and projects radially outwardly and rearwardly about the lower rear portion of said boss 40. The quadrant gear 50 is a part of a motor driven drive means D which is operable to rotate or turn the head H and the antenna A carried by said head about and relative to the central vertical or longitudinal axis of the body B. The drive means D, in addition to the quadrant gear 50, includes a reduction gear box G releasably screw-fastened or otherwise mounted on the lever arm C of the body B. The gear box G has an output shaft 51 on an axis substantially tangential with the quadrant gear 50. A worm gear W is drivingly engaged on the shaft 51 and with the quadrant gear 50. The gear box G has an input shaft which is drivingly engaged or connected with the drive shaft (not shown) of a reversible electric motor 52. In the case illustrated, the gear box G and motor 52 are an integrated assembly or unit wherein the case of the motor 52 is suitably directly fastened to the case of the gear box G whereby said motor is carried by said box.

In the case illustrated, the arm C has a pair of laterally spaced vertical plates 60 fastened to it. The worm gear extends between and is suitably supported by the plates 60. The gear box G of the means D is suitably fastened to one of their plates. The plates 60 are such that they can be adjusted and set longitudinally of the arm C to properly engage the worm W with the quadrant gear 50. Since the structure for mounting the drive means on the arm C and relative to the gear 50 can vary widely in practice, further detailed description of that structure shown in the drawings will be avoided.

In practice, it has been found that a gear reduction ratio of 100 to 1 or 150 to 1 at or in the gear box and a gear reduction ratio of from 50 to 1 to 100 to 1 at the worm gear drive, for a total gear reduction of from 150 to 1 to 250 to 1 is satisfactory. However, if desired or if circumstances require, the gear reduction ratio can easily and conveniently be greatly increased by selecting and using commercially available gear reduced electric motor drives and by using different standard worm quadrant gears.

The drive means D which includes the motor, gear box, worm gear and quadrant gear operate to rotate or turn the spindle S of the head H and the antenna A, carried by the head H, about or relative to the central longitudinal axis of the body B and thereby cause the direction in which the antenna A is aimed or directed along and longitudinally of a predetermined arcuate path, in one direction or the other, as desired or as circumstances require.

In practice, the motor 52 is under control of a suitable remote manually operable switching device or means (not shown) which can be intermittently operated to energize and cause the motor to operate or rotate in a clockwise or counterclockwise direction, as desired or as circumstances require.

It is to be noted that the above referred to predetermined arcuate path, toward which the antenna is directed and relative to which the antenna is moved along or longitudinally thereof, is the Clark belt or any other geostationary orbit belt along which the T.V. relay satellites which the antenna is to be aligned with are set.

It is quite easy to determine when to stop driving or moving the antenna when moving it from alignment from one to the next T.V. relay satellite by watching and/or listening to the output of certain of those signal handling components of the receiving station which respond to the strenghth and/or clarity of the signals received.

To install and put my new dish antenna mounting structure to use, the post P is first set in the earth or ground as securely and as near to vertical as practical. The remainder of the assembly, but without the antenna A related to it, is engaged and secured to the post P by sliding the tube T onto the post, rotating it to a desired rotative position where the front side of the assembly is directed south or toward that portion of the Clark belt which is to be scanned and tightening the fasteners 26 to secure the tube T on the post P. Thereafter, with the aid of a spirit level or the like, the means L is operated to place and set the upper plate 20 of the means L in horizontal position. Then the antenna A is mounted on the plate 46 of the head H. Thereafter, the vertical angle or elevation of the antenna is roughly adjusted and set by operating the turnbuckle 37 of the strut means X and causing the rear end of the arm C to move vertically and to shift the axis of the body B and the spindle S of the head H rearwardly and downwardly or forwrdly and upwardly about the pivotal axis of the body B. In practice, the elevation angles for satellite T.V. antennae throughout the country are well charted and the precise elevation angle at which an antenna, in any location, must be set for alignment with any one of the T.V. relay satellites in the Clark belt is readily accessible from a number of different sources. Accordingly, when first and roughly adjusting and setting the elevation angle of the antenna A by operating the means X, it is both possible and practical to move and set the structure with the aid of a compass scale or the like in accordance with suitable and available charted settings.

When the construction is roughly set in the manner set forth above, the fasteners 31 are set tight. Thereafter, the structure is put into operation and the drive means D is operated to cause the antenna to scan the Clark belt. As with Clark belt is scanned and a signal is first received from a first aligned satellite, the structure is stopped on and in alignment with that satellite and fine declination adjustment of the antenna is effected by suitably loosening the fasteners 47 and 48 and operating the fastener 49. Coincidentally, with operation of the fastener 49, the drive means D can be operated to move the antenna back and forth through that limited portion of its arcuate path until the signal received is as clear and as strong as can be attained. Following the above, the fasteners 47 and 48 are made tight and secure and the installation is completed. Thereafter, the operator of the receiving station, by manual operation of the control switching device provided to operate the motor of the drive means D, can intermittently cause the structure to operate and to cause the antenna A to scan the Clark belt and to thereby move it into receiving alignment with any desired T.V. relay satellite in and/or along that belt.

Further, in practice, after the antenna A is properly aligned with one satellite and upon operating my structure to move it through its intended arc along the Clark belt into alignment with another satellite, if no signal or a weak and inadequate signal is received from said other satellite, it can be assumed that the plate 20 of the means L is not properly set relative to horizontal. When such circumstances are encountered, it is both easy and convenient to fine adjust the means L and H by operation of the drive means D to cause the antenna to scan back and forth along the portion of the Clark belt to be scanned and to adjust and/or set the means L and H, as the antenna is thus moved, until the signals from the relay satellites at the opposite ends of the segment of the Clark belt scanned are adequately and/or properly received.

In practice and as shown in FIG. 1 of the drawings, the structure H can be and is preferably provided with a suitable cover or housing structure 90 which suitably encloses the drive means D, protecting it from the elements and discouraging unauthorized persons from tampering with the structure.

From the foregoing, it will be apparent that the T.V. dish antenna mounting means M that I provide is a simple, yet highly effective and practical, structure that can be made and installed at an extremely modest cost and is a structure which requires little or no special skill to install, operate and maintain.

Having described only one typical preferred form and embodiment of my invention, I do not wish to be limited to the specific details herein set forth but wish to reserve to myself any modifications and/or variations tha might appear to those skilled in the art and which fall within the scope of the following claims:

Having described my invention, I claim:

1. A mounting structure for a television dish antenna comprising an elongate substantially vertical post with a lower end in fixed position relative to the earth and defining a vertical first axis; a levelling structure comprising a lower part secured in set position on an upper portion of said post, an upper part, a central pivot bearing part between said upper and lower parts and first screw means engaged with and between said upper and lower parts to pivot and set said upper part horizontal; an elongate body with an upper outer end and a lower inner end positioned above said levelling structure and defining a longitudinal second axis, coupling means projecting up from said upper part and pivotally mounting said lower end of said body to said upper part about a horizontal third axis, an elongate lever arm projects radially from the upper portion of said body at one side thereof, an elongate axially extensible strut is connected with and extends between said arm and said levelling structure to pivot and set said body about said third axis, a head structure including an elongate shaft part with inner and outer ends concentric with and projecting axially from the upper end of said body for rotation about said second axis, drive means to rotate said shaft relative to the body about said second axis including a driven gear on said shaft, a drive gear rotatably carried by said body and engaging said driven gear and a reversible drive unit carried by the body driving said drive gear, an elongate first carrier part with inner and outer ends at the outer end of said shaft with its longitudinal axis normal to said second axis, a second elongate carrier part with inner and outer end portions extending longitudinally of said first carrier part with its outer end portion projecting from the outer end of said first carrier part, pivot means pivotally connecting the inner end portion of said second carrier part to the inner end portion of the first carrier part for pivotal movement about a horizontal fourth axis spaced above and parallel with said third horizontal axis, a dish antenna mounting plate at the outer end of said second carrier part and second screw means engaged with and between said first and second carrier parts to pivot said second carrier part vertically about said fourth axis.

2. The mounting structure set forth in claim 1 wherein said lower part includes an elongate tube slidably engaged about the upper portion of said post, a horizontal plate fixed to the top of said tube and in stopped engagement with the top of said post and lock screw fasteners engage with and between said tube and post.

3. The mounting structure set forth in claim 1 wherein said lower part of said levelling structure includes an elongate tube slidably engaged with the upper portion of said post, a horizontal plate fixed to the top of said tube and in stopped engagement with the top of said post and lock screw fasteners engaged with and between said tube and post, said upper part is a horizontal upper plate in vertical spaced relationship above said lower plate and a central bearing seat receiving said bearing part, said first screw means includes a plurality of vertical screw fasteners in circumferential and radial outward spaced relationship about said bearing part and engaged with and between said upper and lower plates to move related portions of said plates vertically relative to each other.

4. The mounting structure set forth in claim 1 wherein said lower part of said levelling structure includes an elongate tube slidably engaged with the upper portion of said post, a horizontal plate fixed to the top of said tube and in stopped engagement with the top of said post and a plurality of lock screw fasteners engaged with and between said post and tube, said upper part is a horizontal upper plate in vertical spaced relationship above said lower plate, said plates have central bearing seats, said bearing part is engaged between said seats, said first screw means includes a plurality of vertical screw fasteners in circumferential and radial spaced relationship about said bearing part and engaged with and between said upper and lower plates, said coupling means includes a pair of laterally spaced vertical clevis plates on and projecting up from said upper plate at opposite sides of said body and axially aligned axially, spaced horizontal pivot bolts engaged through said clevis plates and into the lower end of said body.

5. The mounting structure set forth in claim 1 wherein said lower part of said levelling structure includes an elongate tube slidably engaged about the upper portion of said post, a horizontal plate fixed to the top of said tube and in stopped engagement with the top of said post and a plurality of lock screw fasteners engaged with and between said tube and post, said upper part includes a horizontal upper plate in vertical spaced relationship above said lower plate, said plates have central opposing bearing seats, said bearing part is engaged between said seats, said first screw means includes a plurality of vertical screw fasteners in circumferential and radial outward spaced relationship about said bearing part and engaged with and between said upper and lower plates to move related portions of said plates vertically relative to each other, said coupling means includes a pair of laterally spaced vertical clevis plates on and projecting up from said upper plate at opposite sides of the body and axially aligned, axially spaced horizontal pivot bolts engaged through the clevis plates and into the lower end of said body, said body has a central longitudinal bore, said shaft part has an elongate spindle concentric with and rotatably engaged in said bore and an elongate boss at the upper end of the spindle in bearing engagement with the upper end of said body, said first carrier part and said driven gear are carried by said boss.

6. The mounting structure set forth in claim 1 wherein said lower part of said levelling structure includes an elonate vertical tube slidably and rotatably engaged about the upper portion of said post, a horizontal lower plate fixed to the top of said tube and in stopped engagement with the top of said post and a plurality of lock screw fasteners carried by said tube in spaced relationship and engaging said post, said upper part includes a horizontal upper plate in vertical spaced relationship above said lower plate, at least one of said plates has a central concaved seat opposing the other plate, said bearing part is a spherical part engaged between the plates and in said seat, said screw means includes a plurality of vertical screw fasteners in circumferential and radial outward spaced relationship about said bearing part and engaged in and through related pairs of registering openings in said upper and lower plates, said coupling means includes a pair of laterally spaced vertical clevis plates on and projecting up from said upper part at opposite sides of said body and axially aligned, axially spaced elongate horizontal pivot bolts engaged through said clevis plates and into openings in the lower end of said body, said body has a central longitudinal bore, said shaft has an elongate vertical spindle rotatably engaged in said bore and a boss at the upper end of said spindle and engaging the upper end of said body, said first carrier part and said driven gear are carried by said boss, said strut means includes an elongate turnbuckle with opposite ends connected with said tube and with the end portion of said arm remote from said body.

7. The mounting structure set forth in claim 1 wherein said pivot means includes a laterally extending horizontal pivot pin at said inner end of said first carrier part on said fourth axis and engaged through said inner end portion of said second carrier part, said second screw means includes a manually operable screw on an axis normal to and spaced longitudinally outward from said fourth axis and rotatably carried by one carrier part and threadedly engaged in the other carrier part.

8. The mounting structure set forth n claim 1 wherein said pivot means includes a laterally extending horizontal pivot pin on said fourth axis at said inner end of said first carrier part and engaged through said inner end portion of said second carrier part, said second screw means includes a manually opeable screw on an axis normal and spaced longitudinally outward from said fourth axis and rotatably carried by one carrier part and threadedly engaged in the other carrier part, said head structure further includes guide means to guide and secure said second carrier part in set position relative to said first carrier part and including an arcuate slot in the one carrier part spaced from and concentric with said fourth axis, an elongate bolt and nut assembly on an axis parallel with said fourth axis carried by said other carrier part and engaged through said slot and manually operable to releasably clamp the carrier parts together.

9. The mounting structure set forth in claim 1 wherein said strut means includes an elongate turnbuckle with opposite ends connected with the lower part of said levelling structure and with the end portion of said arm remote from said body.

10. The mounting structure set forth in claim 1 wherein said strut means includes an elongate turnbuckle with opposite ends connected with the lower part of said levelling structure and with the end portion of said arm remote from the body, said body has a central longitudinal bore, said shaft has an elongate spindle rotatably engaged in said bore and an elongate boss at the upper end of said spindle in bearing engagement with the upper end of said body, said first carrier part and said driven gear are carried by the boss.

11. The mounting structure set forth in claim 1 wherein said driven gear is a spur gear carried by said body with its axis concentric with said second axis of said body and said drive gear is a worm gear extending tangentially of and engaging said driven gear.

* * * * *